US006416708B1

(12) United States Patent
Van Laar

(10) Patent No.: US 6,416,708 B1
(45) Date of Patent: Jul. 9, 2002

(54) WALL STRUCTURE FOR A METALLURGICAL VESSEL AND BLAST FURNACE PROVIDED WITH A WALL STRUCTURE OF THIS NATURE

(75) Inventor: Jacobus Van Laar, Driehuis (NL)

(73) Assignee: Corus Staal BV, Ca Ijmuiden (NL)

( * ) Notice: Subject to any disclaimer, the term of this patent is extended or adjusted under 35 U.S.C. 154(b) by 0 days.

(21) Appl. No.: 09/623,180

(22) PCT Filed: Mar. 17, 1999

(86) PCT No.: PCT/EP99/01792

§ 371 (c)(1),
(2), (4) Date: Sep. 19, 2000

(87) PCT Pub. No.: WO99/47711

PCT Pub. Date: Sep. 23, 1999

(30) Foreign Application Priority Data

Mar. 18, 1998 (NL) ..... 1008625

(51) Int. Cl.[7] ..... C21B 7/10
(52) U.S. Cl. ..... 266/194; 266/193
(58) Field of Search ..... 266/193, 194; 122/6 A, 6 B

(56) References Cited

U.S. PATENT DOCUMENTS

| | | | | |
|---|---|---|---|---|
| 2,345,188 A | * | 3/1944 | Foell | 266/193 |
| 3,953,007 A | | 4/1976 | Van Laar | |
| 4,314,695 A | * | 2/1982 | Widmer | 266/194 |
| 4,397,450 A | * | 8/1983 | Kammerling et al. | 266/193 |

FOREIGN PATENT DOCUMENTS

| | | | | |
|---|---|---|---|---|
| DE | 0719137 | | 3/1942 | |
| DE | 2713353 A | * | 7/1978 | 266/194 |
| EP | 0021487 | | 1/1981 | |
| EP | 0149575 | | 7/1985 | |
| FR | 1284214 | | 7/1962 | |
| FR | 2160724 | | 7/1973 | |
| FR | 2215468 | | 8/1974 | |
| FR | 2564484 | | 11/1985 | |
| JP | 406065619 A | * | 3/1994 | 266/193 |
| WO | 9854367 | | 12/1998 | |

* cited by examiner

*Primary Examiner*—Scott Kastler
(74) *Attorney, Agent, or Firm*—Stevens, Davis, Miller & Mosher, LLP

(57) ABSTRACT

A wall structure for a metallurgical vessel at the location where the vessel wall, on the hot side, is in contact with liquid metal and/or liquid slag, in particular for the hearth of a shaft furnace, comprising a steel plate lining (2), inside which lining at least one layer of refractory brickwork (15, 16, 17) is arranged, the steel plate lining (2) being joined to the layer (layers) of brickwork by means of mortar joints (5) and/or ramming compound joints (5) to form a cohesive structure, wherein metal bars (11) which run in the circumferential direction inside the steel plate lining (2) and project into the wall are present, which bars are connected to the outer side of the steel plate lining by means of attachment means (20) running through the steel plate lining, each assembly comprising a metal bar (11) and its attachment means (20) and the steel plate lining (2) forming, in the vertical direction, a unit which is sufficiently elastic to maintain a surface-to-surface contact along horizontal surfaces between the metal bars (11) and bricks (15, 16, 17) during operation.

23 Claims, 1 Drawing Sheet

WALL STRUCTURE FOR A METALLURGICAL VESSEL AND BLAST FURNACE PROVIDED WITH A WALL STRUCTURE OF THIS NATURE

FIELD OF THE INVENTION

The invention relates to a blast furnace for iron making, which at least in the hearth portion, comprises a steel plate lining, inside which lining at least one layer of refractory brickwork is arranged, the steel plate lining being joined to the layer (layers) of brickwork by means of mortar joints and/or ramming compound joints to form a cohesive structure. The hearth portion of a blast furnace is often provided with an external cooling system.

BACKGROUND OF THE INVENTION

In modem large-scale blast faces, in which ever higher iron production levels at elevated gas pressure are reached, it is highly important for the period between two renovations of the brickwork to be as long as possible. This may lead to problems, in particular in the area of the hearth.

Especially in the hearth, the brickwork is exposed both to the action of the gas atmosphere in the furnace and to the action of liquid metal and/or liquid slag materials which are present in that area. The gas atmosphere may lead to a chemical attack on the brickwork, often an alkali attack, while the liquid iron may have a combined influence of high temperature, chemical attack and mechanical attack. This attack is partly caused by the fact that the liquid iron is often not saturated with carbon and therefore tends to dissolve carbon from bricks.

In terms of the structure of the hearth brickwork, it is important that the bricks should not crumble on the hot side at high temperature as a result of their tendency towards thermal expansion. It has been found that carbon-containing materials, such as graphite and semigraphite, are most resistant to crumbling under such circumstances, but the composition of these materials means that they are also susceptible to attack from the liquid iron which may or may not be saturated with carbon. This susceptibility manifests itself primarily by these carbon-containing materials being dissolved in the liquid iron.

It has been found that the bricks are not affected by the liquid iron if a solid layer based on a mixture, in various combinations, of solidified iron, slag and coke particles is able to form on the inside of the brickwork. This so-called "skull" forms on the brickwork at a temperature in the region of less than 1100 to 1150° C. In addition, the formation of this skull is also dependent on the speed at which the liquid iron is moving into the hearth. Since liquid iron flows out of the heart periodically only at the location of a few tapping points from the furnace, this liquid iron has not only a vertical flow component but also a flow component in the circumferential direction of the furnace, resulting in a higher speed of movement of iron along the brickwork. This iron flowing past has a tendency to redissolve the skull in this area. Only if the hot side of the brickwork can be kept sufficiently cool by means of sufficiently intensive heat dissipation through this brickwork will the skull formed on this brickwork always be sufficient to protect the brickwork from attack.

It should be noted that the "dead man" phenomenon often occurs in blast furnaces, i.e. a solid plug based predominantly on coke and iron forms inside the hearth. Especially if this "dead man" is extensive and has a low porosity, the circulation speed of liquid iron along the brickwork wall will increase and consequently the attack on the skull will be intensified. This phenomenon also requires an even more intensive dissipation of heat via the brickwork in order to keep the temperature on the hot side of the said brickwork sufficiently low for a skull to remain in place.

Heat dissipation from the hearth brickwork by means of cooling plates which extend deep into the brickwork and through which water flows or by means of so-called "stave coolers" arranged inside the steel plate lining is not preferred. Should the skull happen to fall or melt off and part of the brickwork be dissolved in that area, it is possible for liquid iron to come into contact with, for example, such a water-cooled copper cooling plate which extends deep into the brickwork. In such a situation, the copper of the cooling plate may melt through and then the water flowing into the furnace may lead to an explosion followed by rupture of the wall. For these reasons, it is often preferred to provide the steel plate lining of the wall structure with an external cooling feature for the purpose of cooling the hearth. As a rule, this cooling feature is a spray-cooling system with which the temperature of the steel plate lining can be kept at approximately 50° C. At a steel plate lining temperature of approximately 50° C., it will not always be possible to keep the hot side of the brickwork below a temperature of approx. 1100° C., even if bricks made from graphite and/or semigraphite, which have a good thermal conductivity, are used. In this case, it should be noted that the brickwork must have a sufficient thickness to keep the risk of occasional penetration sufficiently low.

It has been found that mortar joints and ramming compound joints form considerable obstacles to the heat dissipation through the brickwork. The outer layer of bricks is generally placed against the steel plate lining with a mortar or ramming compound between them, in which case the thickness of a mortar joint may, for example, be 3 to 5 mm and the thickness of a ramming compound joint may, for example, be 30 to 120 mm. This joint serves partly to compensate for the dimensional deviations of the steel plate lining and partly to bring about thermal contact between steel plate lining and outer brickwork layer. If a plurality of layers of bricks are employed in the radial direction in the wall structure, it will also be necessary to bridge a joint between these layers, and ramming compound is generally employed for this purpose. In any case, like the joint directly behind the steel plate lining, this joint may also serve as an expansion joint. For example, this joint may be 50 mm wide. It has been found that the mortar and/or ramming compound joints may be responsible for 50 to 80% of the total thermal resistance caused by the brickwork to the outer side of the steel plate lining, if the brickwork comprises bricks with a $\lambda > 20^{w}/m°$ C. This problem can become even greater if the structure "breathes". For example, if there are considerable temperature differences in the steel plate lining, the mortar joint may open up, resulting in an insulating layer of gas. A similar phenomenon may occur if the thermal action of the various bricks causes the joint containing ramming compound to remain insufficiently tight.

SUMMARY OF THE INVENTION

The object of the invention is to provide a solution to these problems and, in particular, to improve the heat dissipation from the hot side of the brickwork in such a manner that a skull can continually be formed there. The invention consists in the fact that, in the hearth portion of blast furnace, metal bars which run in the circumferential direction inside the steel plate lining and project into the wall are present, which bars each are connected to the outer side of the steel plate lining by means of two horizontally spaced attachment means each separately running through the steel plate lining, the attachment means being provided with prestressing means for exerting a prestressing force to ensure that each bar always remains pressed against the bricks to maintain a surface-to-surface contact along horizontal and vertical surfaces between the metal bars and bricks during operation. The combination of improved thermal conductivity through the metal bars with a direct surface-to-surface contact between the metal bars and the bricks along horizontal and vertical surfaces, as a result of the attachment with the prestressing means of the metal bars, to a large extent minimizes the thermal resistance of part of the joints. It should be noted that the vertical attachment of the bars is required in order to ensure that, following assembly of the wall structure, the surface-to-surface contact between bars and bricks is maintained if thermal expansion were to allow the bricks to move slightly in the vertical direction.

Also the thermal resistance of the structure is reduced further if the bars are also prestressed in the radial direction with respect to the steel plate lining to maintain a surface-to-surface contact along vertical surfaces with bricks during operation. Any joint which is present can then be reduced to a width of virtually zero, in which case the thermal resistance of this joint is also very low. This latter effect can be obtained in particular if prestressing means are provided in order to hold the bars pressed against the bricks in the radial direction.

Obviously, there is also a thermal resistance between the metal bars and the steel plate lining. However, the effect of this is negligible if, according to the invention, the metal bars are cooled. According to the invention, one possibility for doing this consists in the metal bars and/or their attachment means being designed at least in part as so-called "heat pipes". Heat pipes are generally known construction components in which a liquid and the vapour phase of this liquid are present inside a closed cavity within these construction components. This allows an intensive flow of heat through the heat pipes. According to another embodiment according to the invention, the metal bars are provided with a duct and with feed and discharge means which are connected to a coolant circuit. Direct cooling of the metal bars means that there is no longer any need to dissipate heat from these bars via the steel plate lining. It is preferable for the metal bars to be made from a metal which comprises predominantly copper. This ensures a good thermal conductivity, while the bars provided with a duct can easily be manufactured from copper. It is important that the bars have some individual mobility. Since the thermal movements which have to be absorbed by this mobility are only slight, this does not cause any major design problems. In a possible embodiment according to the invention, the bars inside the steel plate lining are arranged as broken rings and/or in an offset manner. According to another embodiment, the bars inside the steel plate lining form rings which comprise at least 10 and preferably between 30 and 50 bars. According to a possible embodiment of the novel wall structure, the bars have, on the hot wall side, a curved surface which corresponds to the local radius of curvature of the wall. According to another embodiment, the bars may have, on the hot wall side, flat surfaces which together form a regular polygon. This then makes it possible for the bricks also to be provided with flat boundary faces on their outer radial side. As a result, it is possible to obtain a good level of thermal contact between the bars and the bricks which bear against them in the radial direction.

To achieve a good level of surface-to-surface contact along horizontal surfaces between the bars and the bricks and, furthermore, for other design reasons, it is desirable for the bars to extend 15 to 30 cm in the radial direction from the steel plate lining. Furthermore, according to the invention it is preferable for the bars to be positioned vertically at distances of between 40 and 80 cm.

According to a possible embodiment of the novel blast furnace, the brickwork in the radial direction comprises one layer of bricks which are of different lengths and extend to close to the steel plate lining and to against the bars. This design has the advantage that there is no intervening gap containing ramming compound.

According to another advantageous embodiment of the novel blast furnace structure, the brickwork in the radial direction comprises two layers of bricks, between which the joint for each horizontal layer of bricks is offset in the radial direction. In this case, therefore, there is no continuous joint, but rather bricks in the outer layer and in the inner layer bear against one another turn and turn about with surface-to-surface contact along horizontal surfaces. As a result, the thermal conductivity passes directly via these horizontal surfaces from the inner (in the radial direction) layer of bricks to the outer (in the radial direction) layer of bricks.

Where joints are still present in the proposed blast furnace construction, for example between the steel plate lining and the bars, between the steel plate lining and the bricks, and between bricks which adjoin one another in the radial direction, these joints may, according to the invention, be filled with a plastic, highly thermally conductive compound. However, the bricks may also be placed dry against the steel plate lining. A compound of this nature can be obtained if it contains a tar component which evaporates only at high temperature. This tar component ensures that the compound in the joint remains plastic. In the event of the shape of the joint changing, without a concurrent change in volume, the compound, which in itself has good conductivity will maintain good tight contact with the components which form a joint. A further improvement to the thermal conductivity can be obtained if the compound employed also contains a metal or a metal alloy with a melting point or melting range between 200 and 1100° C., preferably between 200 and 660° C. Tin, for example, melts at approximately 230° C., with the result that metallic thermal bridges are then formed in the joint. The same effect can also be obtained by, for example, arranging tin in the joints which run radially between bricks, i.e. in joints between bricks which lie next to one another in the circumferential direction in the same level. Often, bricks will be laid with a thin layer of mortar between them, but the layer of mortar then also forms a thermal bridge. Particularly if the flow of heat does not run in a purely radial direction, such as for example when the furnace is tapped only via a limited number of tapping holes, it is important for there to be no substantial thermal resistance in the circumferential direction of the brickwork.

The novel invention now allows the brickwork to be almost permanently protected by a skull. As a result the risk involved in using graphite and/or semigraphite and/or carbon-containing material with pores of $\leqq 1$ $\mu$m and a coefficient of thermal conduction $\lambda > 15^{w}/m°$ C. for the bricks is very considerably reduced, and it is therefore also preferably to employ bricks of this nature, due to the fact that bricks made from these materials only crumble under the influence of thermal stresses at very much higher temperatures than other refractory materials and also have a very high thermal conductivity.

The invention also relates to a method of operating a blast furnace. This method makes it possible, given an identical thickness of the brickwork, to dissipate considerably greater amounts of heat, with the result that it is possible to achieve a lower temperature on the hot side of the brickwork. It is recommended for the flow rate of the liquid circuit through the bars to be set to a heat dissipation of >50% of the total heat dissipated from the wall.

BRIEF DESCRIPTION OF THE DRAWINGS

The invention will be explained below with reference to a number of figures.

DETAILED DESCRIPTION OF THE PREFERRED EMBODIMENTS

Figure 1:
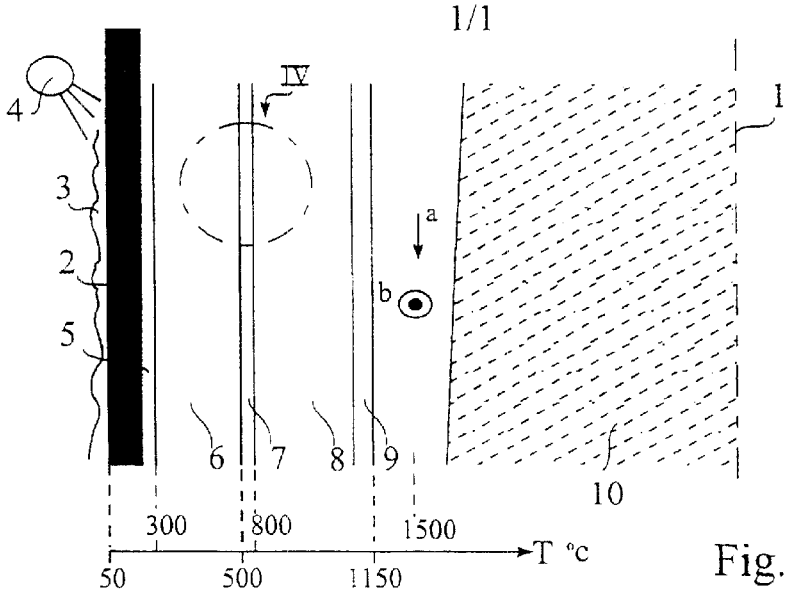
Fig. 1 (Prior Art)
FIG. 1 shows a diagrammatic depiction of a wall structure in a blast furnace which is in general use.

FIG. 1 shows a diagrammatic view, in longitudinal section of part of the wall of a blast furnace hearth. Reference numeral 1 denotes the axis of the hearth and reference numeral 2 denotes a steel plate lining. Steel plate lining 2 is cooled with the aid of a flow of water 3 from a spray cooling system. Following the steel plate lining 2 there are, successively, a joint 5, an outer (in the radial direction) layer of refractory casing 6, a second joint 7, an inner (in the radial direction) layer of casing bricks 8 and a skull 9. The figure also diagrammatically illustrates a solid body of coke and solidified iron 10, which is also known in the specialist field by the name "dead man". When the blast furnace is being tapped, liquid pig iron flows through the hearth in the downwards direction "a" and in the circumferential direction "b", the latter as a result of the fact that the iron is tapped only at a few locations around the circumference of the furnace. The so-called skull comprises solidified material predominantly comprising coke and iron.

For illustration purposes only, and without this beating any relationship to the present invention, a temperature scale is illustrated at the bottom of FIG. 1, illustrating how the temperature profile runs through the wall structure between the water-cooled outer side of steel plate lining 2 as far as into the liquid metal between skull 9 and "dead man" 10.

Although in practice it is sought to keep a mortar joint 5 and a joint 7 containing ramming compound as thin as possible, it can be seen from this temperature scale that a considerable proportion of the temperature difference between the cooling water and the liquid iron is due to the joints 5 and 7. In order to be able to achieve a sufficiently low temperature at the location of the skull 9, it is the object of the invention to improve the dissipation of heat through the wall structure as much as possible and, to this end, to reduce the considerable temperature drops caused by the joints 5 and 7.

Figure 2:
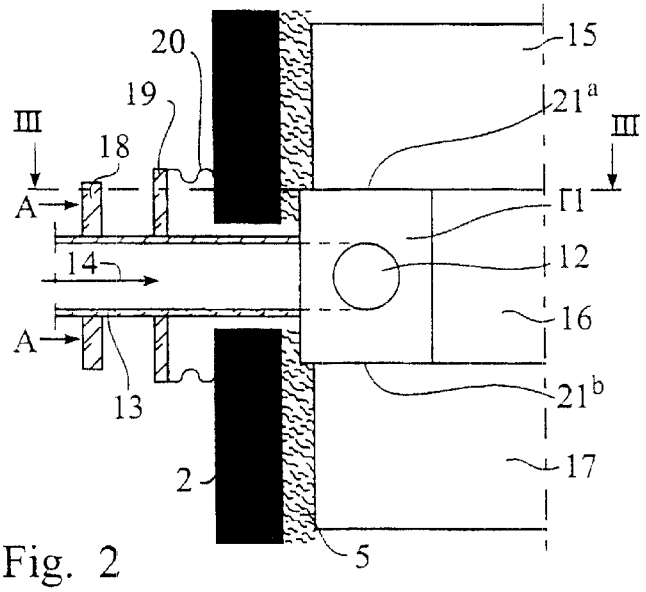
FIG. 2 shows a detail according to the invention in longitudinal section.
Figure 3:
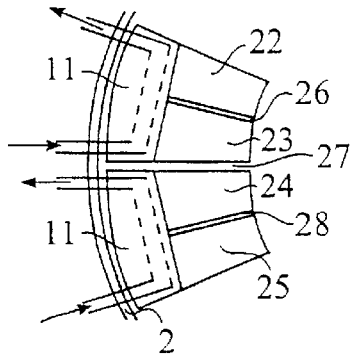
FIG. 3 shows a cross section on III—III in FIG. 2, on a different scale.

FIG. 2 shows part of the wall structure in accordance with FIG. 1 on an enlarged scale and according to the invention. The bricks 15, 16 and 17 of brickwork 6 are shown on the inside of the steel plate lining 2 and on the inside of the joint 5. In addition, a copper bar 11 with a through-bore 12 is situated inside the steel plate lining 2. This through-bore is connected to a feed pipe 13 and a discharge pipe (not shown here). The feed pipe 13 and the discharge pipe are horizontally spaced and run separately through different apertures through the steel plate lining 2, as illustrated in FIG. 3. Water is fed to a through-bore 12 in the direction of arrow 14, with the result that the bar 11 undergoes forced cooling. Contact surface 21*b* of brick 17 bears against the copper bar 11, resulting in a very good thermal contact and a good dissipation of heat from brick 15 to the bar and to the cooling water which flows through it. During construction of the brickwork, it is ensured that the top surface of brick 16 and the top surface of bar 11 also lie accurately in a single plane. If appropriate, this may require a correction using, for example, metal foil. As a result, brick 15 can also be in close contact with bar 11 at the location of contact surface 21*a*. The feed and discharge pipes 13 fit with a clearance into an opening in the steel plate lining, with the result that the bar 11 has a certain freedom of movement in the vertical direction This freedom of movement of the bar 11 is also provided by the elasticity of the connection between the feed and discharge pipes 13 and the steel plate lining 2. The elasticity of the connection can be employed as a prestressing means for prestressing bar 11 against surface 21*a*. Since the bricks 15, 16 and 17 are stacked on top of one another, they have a good thermal contact at their horizontal boundaries and this is also maintained while the structure is heating up via contact surfaces 21*a* and 21*b* with bar 11, even if there is some thermal expansion in the structure, as a result of the elastic mobility of the bar 11 in the vertical direction.

During assembly, brick 16 is placed against the front surface of bar 11, in such a manner that good thermal contact between brick 16 and bar 11 is also ensured. This good thermal contact can also be maintained during thermal deformation of the brickwork during heating, due to a collar 18 on the pipe 13. Exerting a prestressing force A on this collar 18 ensures that bar 11 always remains pressed against brick 16 by this prestressing force. It should be noted that the prestressing force A does not have to be transmitted via the pipes 13, but rather it is also possible for this to act, via a separate through-bore in the steel plate lining, in the centre of the bar. The gas seal for the blast furnace trough the steel plate lining is diagrammatically illustrated by a collar 19 and a bellows 20, which can also provide the elastic connection and the prestressing means between bar 11 and steel plate lining 2. In practice, various designs are available for this purpose.

FIG. 3 shows a diagrammatic, transverse view, on a reduced scale, of cross section III—III in FIG. 2. In this case, two bars 11 are shown inside steel plate lining 2, which bars are provided with flat surfaces on the side remote from the steel plate lining. Inside the steel plate lining 2, the bars form a continuous ring which, on the inside, is in the form of a polygon. Bricks 22–25 bear against the flat inner sides of the bars 11 in the same way as brick 16 in FIG. 2. Joints 26, 27 and 28 between these bricks are illustrated.

Figure 4:
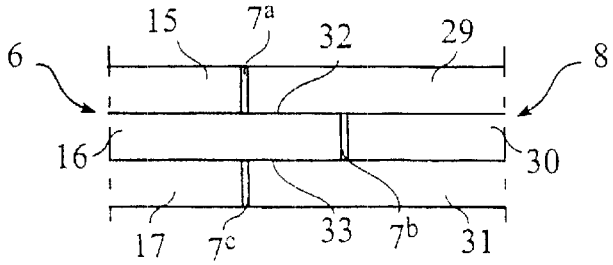
FIG. 4 shows detail IV, from FIG. 1 according to the invention.

FIG. 4 shows detail IV from FIG. 1 in the embodiment according to the invention. In this case, the outer brickwork layer 6 (see FIG. 1) comprises the bricks 15, 16 and 17 (see also FIG. 2). On the inside of these bricks, there are bricks of the brickwork layer 8 (see FIG. 1). These are the bricks 29, 30 and 31, which are separated from the bricks 15, 16 and 17 by partial joints 7*a*, 7*b* and 7*c*. In the novel design, instead of the joint 7 (see FIG. 1) bringing about complete separation between the brickwork layers 6 and 8, the layers 6 and 8 remain in direct thermal contact via the overlapping horizontal contact surfaces 32 and 33. The sudden change in temperature caused by the joint 7 is considerably reduced in this way, thus improving intensive heat dissipation through the brickwork.

Furthermore, a further improvement to the heat dissipation through the wall is obtained by arranging a plastic compound with a high thermal conductivity in the joint 5 (see FIG. 2) and/or in the partial joints 7*a,* 7*b* and 7*c* (see FIG. 4). A compound containing a tar component which evaporates at high temperature and containing metallic tin or a metallic tin alloy is used for this purpose. In order to achieve a good thermal conductivity in the circumferential direction as well, a mortar containing tin as one of its components is also used in the radial joints 26, 27 and 28 (see FIG. 3). When laying the bricks 22–25, these joints 26, 27 and 28 are kept as narrow as possible.

What is claimed is:

1. A blast furnace for iron making, comprising a hearth portion, and which at least in the hearth portion, further comprises:

a steel plate lining (2), at least one layer of refractory brickwork (15, 16, 17) arranged, inside the steel plate lining (2), at least one member of the group consisting of mortar joints (5) and ramming compound joints to join the steel plate lining (2) to the at least one layer of brickwork to form a cohesive structure, metal bars (11) which run in a circumferential direction inside the steel plate lining (2) and project into the refractory brickwork, wherein the bars each are connected to an outer side of the steel plate lining by two horizontally spaced attachment means (13) each separately running through the steel plate lining, the attachment means (13) being provided with prestressing means (18, 19, 20) for exerting a prestressing force to ensure that each bar (11) always remains pressed against bricks (15, 16) of the brickwork to maintain a surface-to-surface contact along horizontal and vertical surfaces between the metal bars and bricks during operation of the hearth.

2. The blast furnace according to claim 1, wherein at least one member of the group consisting of the metal bars (11) and the attachment means (13) for the metal bars (11) are designed at least in part as heat pipes including a closed cavity containing a liquid and the vapour phase of this liquid.

3. The blast furnace according to claim 1, wherein the metal bars (11) are provided with a duct and with feed (14) and discharge ports for connecting to a coolant circuit.

4. The blast furnace according to claim 1, wherein the metal bars (11) are made from a metal which comprises predominantly copper.

5. The blast furnace according to claim 1, wherein the bars (11) inside the steel plate lining (2) have at least one configuration selected from the group consisting of bars which form broken rings and bars arranged in an offset manner.

6. The blast furnace according to claim 1, wherein the bars (11) inside the steel plate lining (2) form rings which comprise at least 10 bars.

7. The blast furnace according to claim 1, wherein the bars (11) have a hot wall side and have, on the hot wall side, a curved surface which corresponds to a local radius of curvature of the wall.

8. The blast furnace according to claim 1, wherein the bars (11) have a hot wall side and have, on the hot wall side, flat surfaces which together form a regular polygon.

9. The blast furnace according to claim 1, wherein the bars extend 15 to 30 cm in the inward radial direction from the steel plate lining (2).

10. The blast furnace according to claim 1, wherein the bars are positioned vertically at distances of between 40 and 80 cm.

11. The blast furnace according to claim 1, wherein the brickwork in the radial direction comprises one layer of bricks which are of different lengths and extend from adjacent the steel plate lining and to against the bars.

12. The blast furnace according to claim 1, wherein the brickwork in the radial direction comprises two layers of bricks, between which a joint for each horizontal layer of bricks is offset in the radial direction.

13. The blast furnace according to claim 1, further comprising joints between the steel plate lining and bars and joints between bricks which adjoin one another in the radial direction, wherein the at least one member of the group consisting of mortar joints and ramming compound joints to join the steel plate lining to at least one layer of brickwork comprises joints between the steel plate lining and bricks, wherein the joints between the steel plate lining (2) and bars (11), between the steel plate lining and bricks, and between bricks which adjoin one another in the radial direction are filled with a plastic, highly thermally conductive compound.

14. The blast furnace according to claim 13 wherein the compound contains a tar component which evaporates at high temperature.

15. The blast furnace according to claim 13, wherein the compound contains a metal or metal alloy with a melting point or a melting range between 200 and 1100° C.

16. The blast furnace according to claim 1, further comprising radially running joints between bricks of the brickwork which lie next to one another in a circumferential direction, and wherein the radially running joints between the bricks contain a metal or metal alloy with a melting point or a melting range between 200 and 1100° C.

17. The blast furnace according to claim 1, wherein the brickwork comprises bricks made from at least one member of the group consisting of graphite, semigraphite, and carbon-containing bricks with pores of $\leqq 1$ $\mu$m and a coefficient of thermal conductivity $\lambda > 15^{w}/m°$ C.

18. A method of operating a blast furnace according to claim 3, comprising flowing coolant liquid from the coolant circuit through the bars, wherein the flow rate of the coolant liquid through the bars (11) is set to a heat dissipation of >50% of the total heat dissipation from the wall.

19. The blast furnace according to claim 1, wherein the bars (11) inside the steel plate lining (2) form rings which comprise between 30 and 50 bars.

20. The blast furnace according to claim 15, wherein the metal or metal alloy has a melting point or melting range between 200 and 660° C.

21. The blast furnace according to claim 16, wherein the metal or metal alloy has a melting point or melting range between 200 and 660° C.

22. The blast furnace according to claim 16, wherein the metal or metal alloy comprises tin.

23. The blast furnace according to claim 15, wherein the metal or metal alloy comprises tin.

* * * * *